United States Patent [19]

Blum et al.

[11] Patent Number: 4,691,179

[45] Date of Patent: Sep. 1, 1987

[54] FILLED RESONANT CAVITY FILTERING APPARATUS

[75] Inventors: Stephen C. Blum, Scottsdale; John Deriso, Tempe, both of Ariz.

[73] Assignee: Motorola, Inc., Schaumburg, Ill.

[21] Appl. No.: 937,954

[22] Filed: Dec. 4, 1986

[51] Int. Cl.[4] ..... H01P 1/207; H01P 7/00; H01P 5/08

[52] U.S. Cl. ..... 333/202; 333/208; 333/209; 333/230; 333/231; 333/246

[58] Field of Search ..... 333/25–27, 333/202, 204–212, 219, 227, 231, 235, 236, 238, 245, 246, 248, 222, 230, 21 R, 24 R; 29/600

[56] References Cited

U.S. PATENT DOCUMENTS

| | | | |
|---|---|---|---|
| 2,704,830 | 3/1955 | Rosencrans | 333/231 |
| 2,829,348 | 4/1958 | Kostriza et al. | 333/238 |
| 3,265,995 | 8/1966 | Hamasaki | 333/253 |
| 4,431,977 | 2/1984 | Sokola et al. | 333/206 |
| 4,523,162 | 6/1985 | Johnson | 333/202 |
| 4,533,884 | 8/1985 | Hudspeth et al. | 333/26 |
| 4,562,416 | 12/1985 | Sedivec | 333/26 |

OTHER PUBLICATIONS

James, et al.-"Aperture Coupling Between Microstrip And Resonant Cavities", IEEE Trans, on Microwave Theory and Techniques, vol. MTT-25, No. 5, May 1977; pp. 392–398.

*Primary Examiner*—Marvin L. Nussbaum
*Attorney, Agent, or Firm*—Lowell W. Gresham

[57] ABSTRACT

An apparatus that utilizes a solid, dielectric-filled waveguide filter in a microstrip circuit is dislosed. The microstrip circuit couples directly into and out from the waveguide filter through slot openings in waveguide filter walls without penetrating the interior of the waveguide. Adjustment of the coupling is accomplished through varying the length of the slot. Resonant frequency tuning of the filter is accomplished using additional slots, or by removing metallic plating from metallized cavities which extend into the waveguide core from a central region of a waveguide broad wall.

23 Claims, 3 Drawing Figures

FILLED RESONANT CAVITY FILTERING APPARATUS

BACKGROUND OF THE INVENTION

The present invention relates generally to electrical filters which operate at microwave frequencies. More particularly, the present invention relates to resonant cavity filters in which the cavity is filled with a solid dielectric material. Furthermore, the present invention is concerned with tuning such filters and coupling them to microstrip circuits.

Resonant cavity filters are known in the art. However, solid dielectric-filled, resonant cavity filters, are relatively new. The interior of such a filter is filled with a solid material, typically a ceramic which exhibits a high dielectric constant. A relatively thin metallic plating clad to the solid material forms the cavity walls.

Many of the known techniques for coupling to and tuning a resonant cavity filter fail to adequately solve coupling and tuning problems associated with solid filled cavities. For example, coupling and tuning techniques which require penetration of the interior of the cavity with probes or other mechanical parts are undesirable for a ceramic filled cavity because the ceramic material may be extremely hard and difficult to penetrate.

Additionally, many known coupling techniques require the use of intermediate components, such as coaxial cables and connectors, in order to couple a resonant cavity to a microstrip circuit. Thus, improvements are further needed to permit direct coupling between microstrip circuits and resonant cavities. Such improvements lower the cost and improve the reliability associated with using resonant cavities with microstrip circuits.

SUMMARY OF THE INVENTION

Accordingly, it is an object of the present invention to provide a solid dielectric-filled, resonant cavity filter that directly couples to a microstrip circuit.

Another object of the present invention concerns coupling to a solid dielectric-filled resonant cavity filter without penetrating the interior of the filter.

Yet another object of the present invention concerns adjusting the amount of coupling into and out from the filter without penetrating the interior of the filter.

Another object of the present invention concerns providing a technique for tuning a solid dielectric-filled, resonant cavity filter without the use of mechanical objects which penetrate the interior of the filter.

The above and other objects and advantages of the present invention are carried out in one form by a microstrip circuit or the like which is mounted on an electrically conducting base so that the microstrip ground plane contacts the base. A metallic plating clad to a solid core serves as a resonant cavity filter and mounts on the electrically conducting base adjacent to the microstrip circuit. A trace on the microstrip circuit extends to the end of the microstrip in the vicinity of the resonant cavity filter. A slot which extends through the metallic plating to the core of the filter is located near the trace. The trace connects to the metallic plating of the filter near the filter slot.

BRIEF DESCRIPTION OF THE DRAWINGS

A more complete understanding of the present invention may be derived by reference to the detailed description and claims when considered in connection with the accompanying drawings, in which like reference numbers indicate similar features, and wherein;

DETAILED DESCRIPTION OF THE PREFERRED EMBODIMENTS

Figure 1:
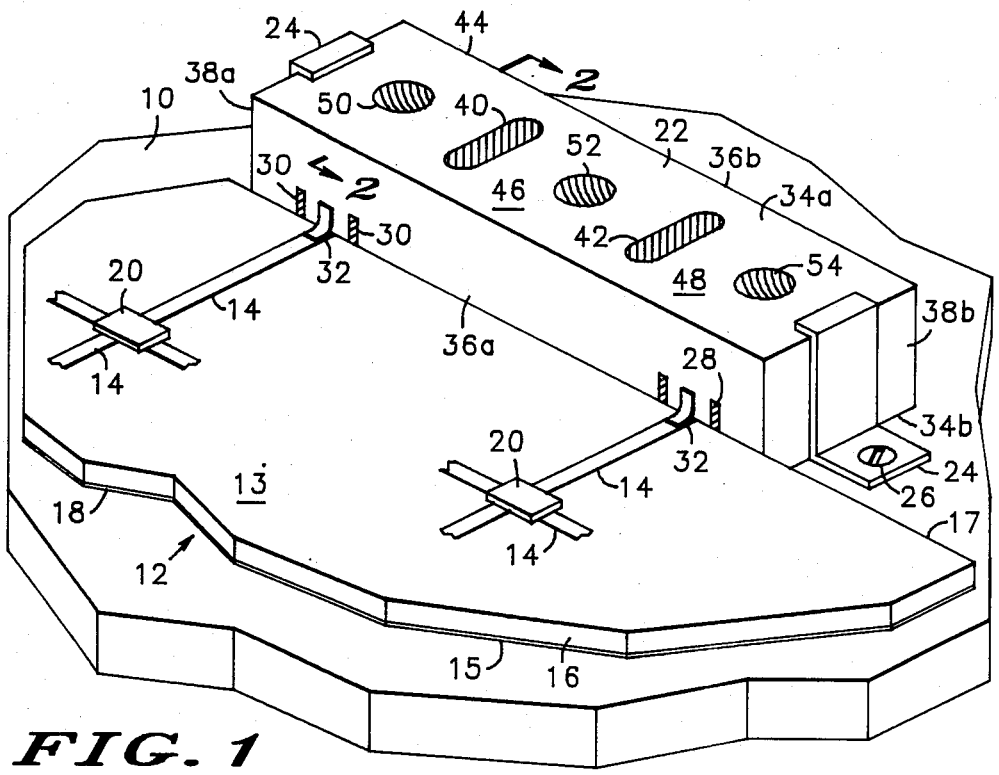
FIG. 1 shows a perspective view of the present invention.

FIG. 1 shows an electrically conducting base 10 which has a substantially planar surface to which a microstrip circuit card 12 and a waveguide filter 22 are attached. A conventional metallic chasis used for microwave circuits may advantageously serve as base 10. Microstrip circuit card 12 contains conductive traces 14 on a top side 13 of a substrate 16. A ground plane 18 resides on a bottom side 15 of substrate 16. Substrate 16 has a predetermined dielectric constant and traces 14 are formed using techniques well known to those skilled in the art. Electrical components 20 may additionally reside on top side 13 of microstrip circuit card 12. Top side 13 and bottom side 15 of substrate 16 represent substantially planar surfaces which reside substantially parallel to each other.

An end 17 of substrate 16 marks a boundary of circuit card 12. Two of traces 14 are routed to end 17 of circuit card 12. Additionally, circuit card 12 is securely fastened to base 10 using solder or electrically conductive epoxy so that ground plane 18 physically contacts and resides generally coplanar with the surface of base 10.

Waveguide filter 22 represents one form of a band pass resonant cavity filter. As is known to those skilled in the art, the waveguide filter represents a particularly low loss type of filter for a given volume. In addition, the interior of waveguide filter 22 contains a solid, dielectric substance which permits reduction in the size of the waveguide filter compared to an equivalent air-filled waveguide filter. Waveguide filter 22 is securely fastened to the planar surface of base 10 using fastening clamps 24 and screws 26. Waveguide filter 22 resides on base 10 immediately adjacent to end 17 of circuit card 12. An input coupling slot 28 and an output coupling slot 30 are located on waveguide filter 22 so that they are near, or proximate, the traces 14 of circuit card 12 which have been routed to end 17 of circuit card 12. Input coupling slot 28 and output coupling slot 30 permit inductive coupling of the microstrip circuit on circuit card 12 to waveguide filter 22. Accordingly, two of ribbon conductors 32 physically connect two of traces 14 at end 17 to one side of coupling slots 28 and 30, respectively.

Waveguide filter 22 represents a $TE_{101}$, or dominant, mode filter. Thus, waveguide filter 22 represents a solid rectangular shape having six walls or sides. Broad walls **34*a* and 34*b* are located on parallel, opposing sides of this solid rectangle and represent the sides of the solid rectangle which contain the largest amount of surface area. End walls 38*a* and 38*b* reside on parallel, opposing sides of this solid rectangle and represents the sides having the smallest amount of surface area. Side walls 36*a* and 36*b* represent parallel, opposing sides of this solid rectangle, and each contains a surface area which is less than the surface area of a broad wall 34 but greater than the surface area of an end wall 38. In the preferred embodiment of the present invention, broad walls 34 each measure approximately 3.23 inches by 0.77 inches, side walls 36 each measure approximately 3.23 inches by 0.385 inches, and end walls 38** each measure approximately 0.77 inches by 0.385 inches.

Input and output coupling slots 28 and 30 each represent non-conducting regions in a wall of waveguide filter 22. In the preferred embodiment input coupling slot 28 and output coupling slot 30 reside on side wall 36*a*. A voltage develops across input coupling slot 28 due to the coupling of trace 14, which is electrically driven by electrical components 20, to one side of slot 28 and of ground plane 18 to the opposing side of slot 28. Ground plane 18 couples to the opposing side of slot 28 through base 10 and the walls of waveguide filter 22. This voltage which develops across slot 28 causes RF energy to propagate within waveguide filter 22. The current of this RF energy originates in the central area of one of broad walls 34, courses over side and end walls 36 and 38, respectively, and diminishes to zero again on the opposing broad wall 34.

Output slot 30 operates similar to input coupling slot 28 except that RF energy is coupled out from waveguide filter 22 to trace 14. For output slot 30, the RF energy propagating in waveguide filter 22 causes a voltage to develop across output coupling slot 30, and that voltage permits the RF energy to propagate along the microstrip circuit.

In the present embodiment waveguide filter 22 contains three separate resonant cells 44, 46, and 48. An inductive post 40 separates resonant cell 44 from resonant cell 46, and an inductive post 42 separates resonant cell 46 from resonant cell 48. Thus, resonant cells 44 and 48 reside next to end walls 38*a* and 38*b*, respectively, and resonant cell 46 resides between resonant cells 44 and 48.

In the preferred embodiment inductive posts 40 and 42 are each constructed through the use of an elongated, or oval-shaped, hole which extends through waveguide filter 22 between broad walls 34 of waveguide filter 22. A longer cross-sectional dimension of the elongated holes resides substantially parallel to end walls 38 of waveguide filter 22, and extends for approximately 0.28 inches. A shorter cross-sectional dimension of the elongated holes extends substantially parallel to the side walls 36 of waveguide filter 22 for approximately 0.093 inches. The same metallic, conductive material which forms the waveguide walls coats, or is clad to, the walls of these holes to form inductive posts 40 and 42. Consequently, the posts tend to block the coupling of RF energy between adjacent cells. In the present embodiment, the particular dimensions used for inductive posts 40 and 42 were determined empirically, and those skilled in the art will recognize that a wide variation in shapes and sizes may be tolerated.

Tuning cavities 50, 52, and 54 reside centrally located on broad wall 34*a* within each of cells 44, 46, and 48, respectively. Tuning cavities 50, 52, and 54 permit adjustments to the resonant frequency of waveguide filter 22, and are centrally located on broadside 34*a* to minimize losses associated with this tuning function.

Figure 3:
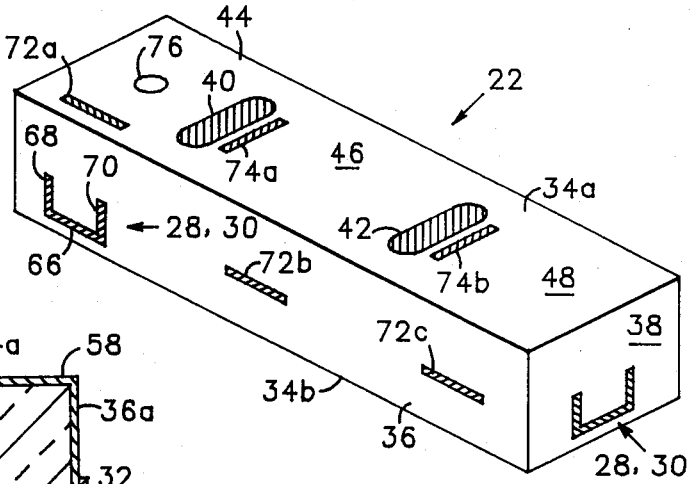
FIG. 3 shows an alternate embodiment of a waveguide filter portion of the present invention.
Figure 2:
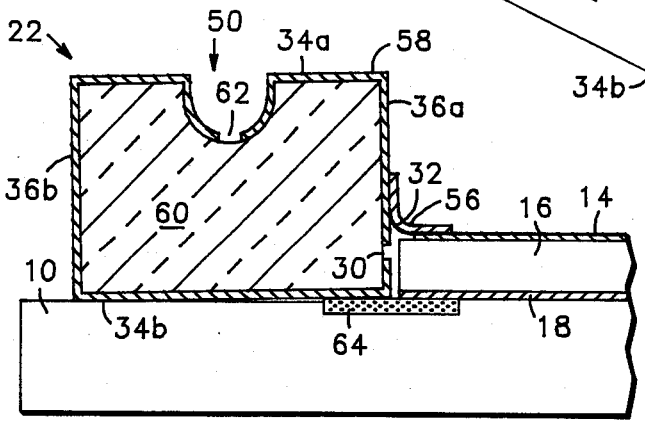
FIG. 2 shows a cross-section view of the present invention taken across line 2—2 of FIG. 1.

Coupling slots 28 and 30, as shown between the various views of FIGS. 1, 2, and 3, permit adjustment to the amount of coupling between microstrip circuit 12 and waveguide filter 22. Waveguide filters require an optimal degree of coupling of RF energy into and out from the waveguide filter. Accordingly, the present invention provides a technique for achieving this optimal amount of coupling. This optimal amount of coupling is typically less than a maximum amount of RF energy coupling which may be achievable. Rather, this optimal amount of coupling, which may also be called "tight" coupling, provides a relatively "flat" or invariant response to RF energy propagated through waveguide filter 22 at any frequency within a band pass range of frequencies of the filter.

In general, the greater the length of a slot in a direction perpendicular to the flow of current along the wall of a waveguide, the greater the amount of coupling into or out from the waveguide. Accordingly, one may adjust the amount of coupling into and out from waveguide filter 22 by starting with a relatively short slot 28 or 30 which resides substantially perpendicular to the flow of current, or parallel to broad walls 34. Then, the length of slots 28 and 30 may be increased until the optimal amount of coupling is achieved.

Although this technique works adequately in some applications, it causes a relatively difficult tuning adjustment procedure. In the preferred embodiment, as shown in FIGS. 1 and 2, a portion of slots 28 and 30 which resides parallel to broad walls 34 also resides between top and bottom surfaces 13 and 15 of microstrip dielectric substrate 16. Thus, when waveguide filter 22 and microstrip circuit card 12 have been securely fastened on base 10, this portion of slots 28 and 30 is obscured by circuit card 12 and cannot be enlarged. Additionally, small increases in the length of the portion of slots 28 and 30 which reside parallel to broad walls 34 cause relatively large increases in the amount of coupling into and out from waveguide filter 22.

On the other hand, the structure shown in FIGS. 1 and 3 for slots 28 and 30 permits a relatively easy coupling adjustment procedure. Referring to FIG. 3, coupling slots 28 and 30 each have a portion 66 which resides substantially parallel to broad walls 34. Furthermore, each of coupling slots 28 and 30 have first and second slot portions 68 and 70, respectively. Slot portions 68 and 70 each extend from one end at opposing ends of slot portion 66 perpendicularly toward broad wall 34*a*. Second and third portions 68 and 70 are initially formed shorter than anticipated for optimal coupling, then extended in length until optimal coupling is achieved. Since second and third portions 68 and 70 extend beyond top side 13 of circuit card 12 (see FIG. 1), they may easily be extended once circuit card 12 and waveguide filter 22 have been installed on base 10. Furthermore, since slot portions 68 and 70 extend substantially perpendicular to broadwalls 34, basically parallel to the lines of current coursing over side walls 36, a given increase in the length of slots 68 and 70 causes a smaller amount of coupling increase than would be caused by increasing first portion 66 of slots 28 and 30. A vernier which provides finer adjustment control over the coupling results. In the preferred embodiment, first portion 66 of slots 28 or 30 is approximately 0.20 inches long, and second and third portions 68 and 70, are each approximately 0.15 inches long before coupling adjustments are made. Each of portions 66, 68, and 70 are approximately 0.025 inches wide. After coupling adjustments, each of portions 68 and 70 are typically about 0.16 inches long.

As shown in the cross-sectional view of FIG. 2, filter 22 contains solid core 60. In the preferred embodiment core 60 is made from a tin-zirconium teratitanate ceramic which is molded in a conventional manner and then fired at high temperatures. The resulting ceramic exhibits a dielectric constant of approximately 36. This core provides the mechanical dimensions, rigidity, and strength for the waveguide. Additionally, the relatively high dielectric constant of core 60 causes a majority of the electric field to remain within core 60. Resultingly, losses due to slots in walls of waveguide filter 22 are significantly less than corresponding losses would be in an air-filled waveguide filter.

After core 60 has been manufactured, a metallic plating 58 is clad to the entire outside of core 60. In the preferred embodiment metallic plating 58 is made from silver and is applied at a thickness of approximately 0.0002 to 0.0005 inches. After the application of metallic plating 58, portions of plating 58 are removed to form coupling slot 30. Metallic plating 58 may be removed to form slot 30 through the manual operation of a high speed drill within an abrading attachment. Since coupling slot 30 permits adjustment for the amount of coupling between waveguide filter 22 and trace 14, the precise dimensions and orientatlons of the portions of slot 30 are not critical.

Cavity 50 represents a semi-spherical hole having a radius of approximately 0.109 inches. As shown in FIG. 2, metallic plating 58 is initially applied to core 60 within cavity 50. The dimensions of cavity 50 are not critical. Thus, cavity 50 is formed in core 60 during the molding process and prior to the firing process when core 60 is soft enough to be workable.

The tuning of filter 22 to a predetermined resonant frequency, which in the preferred embodiment is approximately 1575 Mhz, is accomplished by removing portions of metallic plating 58 from the inside of cavity 50, leaving a tuning void 62 in metallic plating 58. Referring to FIG. 1, the tuning process may advantageously be accomplished by using a network analyzer in a manner known to those skilled in the art to first tune cells 44 and 48. After cells 44 and 48 have been tuned then cell 46 may be tuned.

Referring back to FIG. 2, cavity 50 causes metallic plating 58 in the region of cavity 50 to reside closer to the portion of metallic plating 58 on opposing broad wall **34*b* of core 60. Consequently, an increase in distributed capacitance occurs. The increase in capacitance tends to decrease the resonant frequency of waveguide filter 22 from a resonant frequency which would result from a waveguide filter which did not contain a cavity 50. On the other hand, removal of metallic plating 58 from a portion of cavity 50 decreases the capacitance in this region of waveguide filter 22 and therefore causes the resonant frequency to increase. Without provisions for tuning waveguide filter 22, the resonant frequency of waveguide filter 22 would vary approximately ±3 percent due to material and dimensional variations of core 60. Accordingly, cavity 50 is located in a position and has a size which, when metallized, causes the resonant frequency of waveguide filter 22 to decrease by an amount slightly greater than this 3 percent. Furthermore, since cavity 50 has a semi-spherical shape, it has substantially no corners. The lack of corners permits access to all of metalllc plating 58 clad to core 60 within cavity 50. A greater range of resonant frequency increase results than would be attainable if small portions of metallic plating 58 remained in corners. In the preferred embodiment, the precise size of cavity 50 was determined empirically. The location of cavity 50 in the center of broad wall 34*a*, between side walls 36, for each of cells 44, 46, and 48 (see FIG. 1) minimizes losses caused by removing a portion of metallic plating 58 from cavity 50**.

FIG. 2 shows a conductive ribbon 32 which connects trace 14 to metallic plating 58 of waveguide filter 22. In the preferred embodiment ribbon conductor 32 is made from silver, which exhibits some degree of elasticity. Furthermore, ribbon conductor 32 is soldered between trace 14 and metallic plating 58 so that a predetermined radius 56 exists in making this right-angle connection. The use of such a radius enhances the elasticity of conductive ribbon 32. Since core 60, substrate 16, and base 10 may be made from different materials, each material may expand or contract at different rates as the present invention experiences a temperature change. The use of resilient conductive ribbon 32 to connect trace 14 to waveguide filter 22 reduces mechanical stresses which might otherwise be caused by differences in thermal expansion of the materials involved.

FIG. 2 additionally shows a resilient, conductive member 64 located between and in contact with metallic plating 58 and base 10 on one end and between ground plane 18 and base 10 on the other. In the present invention ground plane 18 electrically drives one side of slot 30. Accordingly, reliability of the present invention is enhanced by insuring that a good electrical connection exists between ground plane 18 and metalllc plating 58 in the vicinity of slot 30. In the preferred embodiment resilient, conductive member 64 represents a copper spring which is biased to move toward ground plane 18 and toward metallic plating 58.

FIG. 3 shows alternate embodiments of the coupling and tuning used in the present invention. For example, FIG. 3 shows that either of input and output coupling slots 28 and 30 may be located on end walls 38, and need not be located on side walls 36. Alternatively, coupling slots 28 and 30 may be located on broad walls 34. However, on broad walls 34 a given slot length will cause a smaller amount of coupling into and out from waveguide filter 22 when compared to a similar slot on side walls 36 or end walls 38.

FIG. 3 additionally shows an alternative embodiment for tuning a predetermined resonant frequency of waveguide filter 22. Slots **72*a*, 72*b*, and 72*c* each represent openings through metallic plating 58 (see FIG. 2) in the center of cells 44, 46, and 48, respectively, of waveguide filter 22. Each of slots 72*a*, 72*b*, and 72*c* are similar to coupling slots 28 and 30 in that they represent a nonconductive region in the waveguide wall of waveguide filter 282**.

Discontinuities in wall currents of waveguide filter 22 tend to be inductive by nature. Thus, by increasing the length of tuning slot **72*a*, 72*b*, or 72*c*, the resonant frequency of waveguide filter 22 decreases. In addition, the resonant frequency of waveguide filter 22 may be increased by decreasing the capacitance of a cell. Decreasing capacitance may be accomplished by removing metallic plating 58 (see FIG. 2) in a region of a cell where the E-field of the resonator is at a maximum, such as in the center of a broad wall 34 as shown at capacitance void 76 in FIG. 3. The operation of capacitance void 76 in FIG. 3 is similar to the operation of tuning void 62 shown in FIG. 2. Accordingly, using this alternative embodiment, the resonant frequency of waveguide filter 22 may be tuned upward or downward. Compared to the tuning technique discussed above in connection with FIG. 2, this tuning technique causes a more lossy filter but does not require any indentation or cavity within the general outline of core 60**.

FIG. 3 further shows slots 74*a* and 74*b* through metallic plating 58 (see FIG. 2) on broad wall 34*a* near inductive posts 40 and 42, respectively. Slots 74*a* and 74*b* permit adjustment of the inter-cell coupling between cells 48 and 46, and between cells 46 and 44, respectively. The major influence which controls the amount of coupling between adjacent cells is the inductance of inductive posts 40 and 42. However, slots 74*a* and 74*b* also act as inductances. Thus, slots 74*a* and 74*b* appear as inductances in series with inductive posts 40 and 42, respectively. In other words, slots 74*a* and 74*b* impede wall currents which would otherwise course down inductive posts 40 and 42, respectively.

In the preferred embodiment emperical observations have suggested that inter-cell coupling is relatively repeatable from unit-to unit. In other words, it does not vary significantly between different ones of waveguide filter 22. Thus, adjustments to inter-cell coupling are not needed in the preferred embodiment. However, other applications may benefit from an extremely precise control over inter-cell coupling as may be permitted by the use of slots 74*a* and 74*b*.

Thus, the present invention permits the direct coupling of a microstrip circuit to a solid dielectric filled, resonant cavity filter without penetrating the interior of the filter. Additionally, input and output slots 28 and 30 (see FIG. 1) permit adjustment over the amount of coupling into and out from the filter without penetrating the interior of the filter. The use of portions 68 and 70 of slots 28 and 30 (see FIG. 3), which reside substantially parallel to the direction of current flow in the waveguide walls, enhances the ability to make these adjustments. Further, the resonant frequency tuning features do not require mechanical parts to penetrate the interior of the filter.

The foregoing description uses preferred embodiments to illustrate the present invention. However, those skilled in the art will recognize that a wide variety of changes and modifications may be made in these embodiments without departing from the scope of the present invention. For example, although microstrip circuits are easily adapted in the present invention, nothing prohibits the use of stripline circuits as well. Also, the present invention could be practiced using a coplanar waveguide structure rather than a microstrip. Using a coplanar waveguide, the waveguide could reside on the substrate that contains the coplanar waveguide rather than on a chasis as shown in the preferred embodiment. Furthermore, types of resonant cavity filters other than the waveguide filter discussed herein may benefit from the teachings of the present invention. Waveguide filters having a different number of cells than the three-cell waveguide filter discussed herein may be adapted for use in the present invention. Still further, those skilled in the art will recognize that the materials and dimensions discussed herein are each subject to a wide range of variation while applying the teaching of the present invention to various specific applications. These and other changes and modifications obvious to those skilled in the art are intended to be included within the scope of this invention.

We claim:

1. A filtering apparatus for electrical energy, said apparatus comprising:

an electrically conducting base having a substantially planar surface;

a substantially planar substrate having a ground plane on one side thereof, a conducting trace on an opposing side thereof, and an end substantially perpendicular to both the ground plane and the trace, said substrate being mounted to said base so that said substrate ground plane resides substantially parallel and in contact with the surface of said base;

a solid core mounted on said base proximate the end of said substrate;

a metallic plating clad to said core and having a slot therein extending through said metallic plating to said core, the slot being located proximate the trace of said substrate; and means for connecting the trace of said substrate to said metallic plating proximate the slot.

2. A filtering apparatus as claimed in claim 1 wherein said core has opposing and substantially parallel broad walls, opposing side walls, and opposing end walls, said core and the slot in said metallic plating being positioned so that the slot resides on one of said side and end walls.

3. A filtering apparatus as claimed in claim 2 wherein a portion of the slot in said metallic plating resides substantially parallel to the broad walls of said core.

4. A filtering apparatus as claimed in claim 3 wherein a second portion of the slot in said metallic plating resides substantially perpendicular to the broad walls of said core.

5. A filtering apparatus as claimed in claim 4 wherein a third portion of the slot in said metallic plating resides substantially perpendicular to the broad walls of said core, said second and third portions of the slot being separated by said portion of said slot which resides substantially parallel to the broad walls of said core.

6. A filtering apparatus as claimed in claim 1 wherein said means for connecting comprises a resilient conductive ribbon for relief of mechanical stresses caused by thermal expansion.

7. A filtering apparatus as claimed in claim 1 additionally comprising a resilient, conducting member located between said metallic plating and the surface of said conducting base.

8. A filtering apparatus as claimed in claim 1 wherein:

said core has opposing broad walls, opposing side walls, and opposing end walls; and at least one of said core said metallic plating are configured to permit tuning of the filter to a predetermined resonant frequency.

9. A filtering apparatus as claimed in claim 8 wherein said metallic plating is configured to provide resonant frequency tuning by being provided with a second slot through said metallic plating to said core.

10. A filtering apparatus as claimed in claim 8 wherein:

said core is configured to provide resonant frequency tuning by containing a cavity therein extending from one of the walls of said core into the interior of said core; and the metallic plating is configured to provide resonant frequency tuning by being clad to said core only within a portion of said core cavity.

11. A filtering apparatus as claimed in claim 10 wherein said core cavity is centrally located between the side walls on one of the broad walls of said core.

12. A filtering apparatus as claimed in claim 10 wherein a portion of said cavity located within said core is configured so that said portion of the cavity has substantially no corners.

13. A filtering apparatus as claimed in claim 8 wherein:

said core has a hole extending between the broad walls of said core said metallic plating is clad to said core within said hole so that the hole forms an inductive post that divides said core into two cells; and said metallic plating is configured to provide an optimal amount of coupling between said two cells by containing a second slot through said metallic plating to said core, said second slot being located on one of the broad walls of said core proximate the hole.

14. A method of coupling between a waveguide filter having a metallic plating clad to a solid core and an electrical circuit having a conductive trace on a first side of a substantially planar substrate and a ground plane on a second side of the substrate, the substrate first and second sides being substantially parallel and spaced apart from one another by the substrate, said method comprising the steps of:

routing the trace substantially to a first end of the substrate;

mounting the substrate and the filter on a conductive base having a substantially planar surface, said mounting being so that the ground plane of the electrical circuit and the metallic plating of the filter contact the conductive base surface and so that the filter resides substantially adjacent to the first end of the substrate;

forming a slot through the filter metallic plating to the filter core proximate the trace; and connecting the trace to the metallic plating proximate the slot.

15. A method as claimed in claim 14 wherein said filter has opposing broad walls, opposing side walls, and opposing end walls, and said forming step comprises the step of positioning the slot on one of the side and end walls of the filter.

16. A method as claimed in claim 15 wherein said positioning step comprises the step of orienting the slot so that at least a portion of the slot resides substantially parallel to the broad walls of the core.

17. A method as claimed in claim 16 wherein said positioning step comprises the step of shaping the slot so that a second portion of the slot resides substantially perpendicular to the broad walls of the core.

18. A method as claimed in claim 15 additionally comprising the step of configuring at least one of the metallic plating and the core to permit tuning of the filter to a predetermined resonant frequency.

19. A method as claimed in claim 18 wherein said configuring step comprises the step of forming a second slot through the metallic plating to said core.

20. A method as claimed in claim 18 wherein said configuring step comprises the step of forming a cavity in the core, the cavity extending from one of the broad walls of the core into the interior of the core, the metallic plating being clad to said core only within a portion of the core cavity.

21. A method as claimed in claim 20 wherein said forming a cavity step comprises the step of centrally locating the cavity between the side walls on one of the broad walls of the core.

22. A method as claimed in claim 20 wherein said forming a cavity step comprises the step of preventing a portion of the cavity located within the core from having a corner.

23. A filtering apparatus for electrical energy, said apparatus comprising:

an electrically conducting base having a substantially planar surface;

a substantially planar substrate having a ground plane on one side thereof, a conducting trace on an opposing side thereof, and an end substantially perpendicular to both the ground plane and the trace, said substrate being mounted to said base so that said substrate ground plane resides substantially parallel and in contact with the surface of said base;

a solid core having opposing and substantially parallel first and second broad walls, opposing side walls, opposing end walls, and a cavity extending from a central region of the first broad wall into the interior of said core so that substantially no corners exist in the cavity, said core being mounted on said base proximate the end of said substrate and so that the second broad wall resides substantially parallel and in contact with the surface of said base;

a metallic plating clad to said core and having a slot therein extending through said metallic plating to one of the side and end walls of said core, the slot having a portion thereof residing substantially parallel to the broad walls of said core, another portion thereof residing substantially perpendicular to the broad walls of said core, and the slot being located proximate the trace of said substrate; and means for connecting the trace of said substrate to said metallic plating proximate the slot.

* * * * *